United States Patent [19]

Ruaud

[11] Patent Number: 4,697,052

[45] Date of Patent: Sep. 29, 1987

[54] EMERGENCY SWITCHING APPARATUS

[75] Inventor: Xavier Ruaud, Soyaux, France

[73] Assignee: La Telemecanique Electrique, France

[21] Appl. No.: 812,685

[22] Filed: Dec. 23, 1985

[30] Foreign Application Priority Data

Dec. 28, 1984 [FR] France ..... 84 19988

[51] Int. Cl.[4] ..... H01H 27/08

[52] U.S. Cl. ..... 200/43.07; 200/153 V; 200/328

[58] Field of Search ..... 200/153 V, 43.07, 43.13, 200/328

[56] References Cited

U.S. PATENT DOCUMENTS 3,773,997 11/1973 Evans et al. ..... 200/153 V
3,940,585 2/1976 Schaad ..... 200/153 V
4,182,943 1/1980 Butterworth ..... 200/328
4,315,123 2/1982 Fujita et al. ..... 200/328

FOREIGN PATENT DOCUMENTS 2263762 7/1974 Fed. Rep. of Germany ..... 200/328

*Primary Examiner*—Henry J. Recla
*Assistant Examiner*—Renee S. Luebke
*Attorney, Agent, or Firm*—William A. Drucker

[57] ABSTRACT

An emergency switching apparatus is provided having an operating button which keeps the trace of its actuation and controls an electric switch.

The switch is struck by a piston which is itself driven by a spring which is loaded by the longitudinal movement of the button, and which is freed by the retraction of the latches, having, on the one hand, an antagonistic effect to that of the spring and, on the other hand, an action latching the button when these latches have ridden over a projection on which they were bearing beforehand.

5 Claims, 4 Drawing Figures

EMERGENCY SWITCHING APPARATUS

BACKGROUND OF THE INVENTION

1. Field of the Invention

The invention relates to a switching apparatus comprising an emergency push-button returned to a neutral position by a return spring and concentric with a tubular body receiving an internal sliding part which is retained by a resilient latch in the inactive position before the push-button is struck and is held in an active position by this same latch when this push-button has travelled over a given distance when it is struck, said sliding part being abruptly propelled towards an electric switch by means of a loaded spring placed between it and the push-button.

2. Description of the Prior Art

In such a switch which is known for example from the French Patent Application No. 82 02355, filed on 12th February 1982 for "Emergency stopping device" in the name of the Applicant, the resilient latch and the locking means are in the form of resilient fingers with ramps adapted for cooperating with slanting projections on the body.

In this known switch, the separation of the roles played by the latches before tripping and by the locking means after such tripping results from a desire to control the use of the apparatus such that even actuation of the push-button over a distance not having been able to cause actuation of the switch must be made visible by a particular position of this push-button.

The degree of such protection may in some cases be considered as exaggerated to the extent that an accidental and limited pressure exerted on the push-button cannot be totally excluded, and may even pass unnoticed since, in this case, the switch has not been actuated.

To obtain such quality of protection further requires the use of numerous parts and in particular two concentric sliding parts which it is difficult to house in the body of the push-buttons where the maximum diameter of these latter does not exceed 30 mm or so.

The invention proposes then providing a safety switching device in which the number of moving parts is considerably reduced so as to be able to be housed in a body of small diameter, while continuing to benefit from fraud-proof properties making it practically impossible to actuate the switch as long as the push-button has not reached a position in which its rearward return is impossible; furthermore, this apparatus must have faultless operation relative to forced actuation of the switch if a resilient element placed in the kinematic chain happened to break at the moment when the result of an emergency actuation must be guaranteed.

SUMMARY OF THE INVENTION

In accordance with the invention, the desired aim is attained because a piston, which represents said sliding part and which moves inside a bore at one end of the body, is placed about a connecting rod or coaxial bolt, a first end of which is integral with the emergency push-button and a head of which is placed in the vicinity of the switch push-rod, so as to actuate this switch push-rod if said piston has not been able to move towards its active position.

BRIEF DESCRIPTION OF THE DRAWINGS

The invention will be better understood from reading the following description with reference to the accompanying drawings in which.

DESCRIPTION OF THE PREFERRED EMBODIMENT

Figure 1:
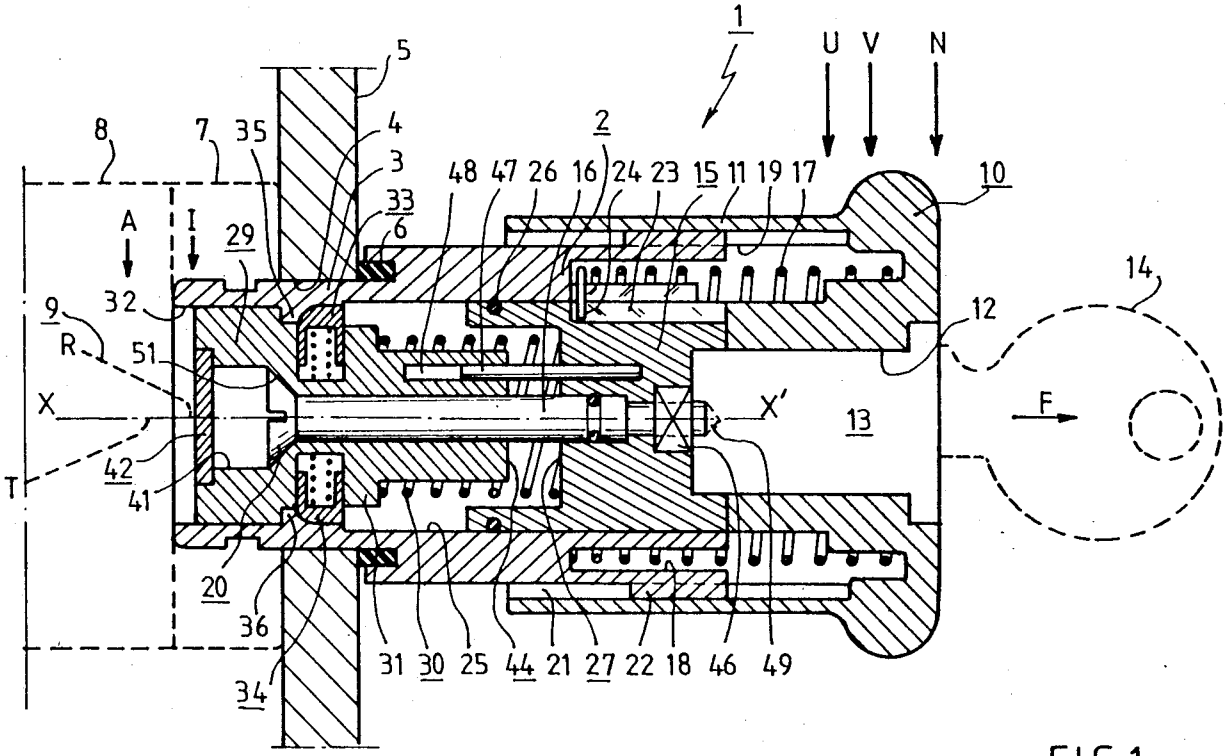
FIG. 1 shows in elevation, in longitudinal section through the axis of revolution, an emergency switching apparatus in accordance with the invention.

A switch 1 in accordance with the invention and shown in FIG. 1 comprises a tubular body 2, a portion 3 of which passes through an opening 4 in a board 5 in which it is sealingly connected by an external seal 6 and a nut 7; this nut which is not illustrated in detail also serves for holding the case of a switch 8 whose actuating pushrod 9 is shown in the rest position —R— in the part of the figure placed above the axis XX' of the body and in the working position T in the other part.

A control push-button 10, having an external skirt 11 which slides along the body, receives in a housing 12 a rotary lock cylinder 13 adapted for receiving a key 14 and being connected angularly and axially to a slider 15 by means of a coaxial bolt 16 whose end 49 extends for example into the lock cylinder. A return spring 17, which is partially placed in an annular housing 18 of body 2 and partially in an annular housing 19 of the push-button, communicates to this latter a return force directed in direction F, rightwards of the figure, for bringing it into a neutral position —N— where it is retained by longitudinal stopping means.

These elements alone allow direct actuation of the switch actuating push-rod 9 to be caused on the sole condition that the shank of bolt 16 is long enough for the head 20 of this bolt to be placed in its vicinity and provided that the stroke of the push-button 10 is sufficient.

Push-button 10 is secured from rotating with respect to body 2 by the cooperation of grooves 21 of one and projections 22 of the other, whereas the cylinder 13 may rotate in its housing 12 when the key is present. If a rotation is communicated to the key, the slider 15 is driven angularly from its rest position causing the twisting of spring 17 one end of which 24 is firmly held by penetration in groove 23; this same end therefore provides a return torque towards the rest position when the key is released and/or removed.

The slider 15 which sealingly slides inside bore 25 of the body because of the presence of a seal 26 has a front bearing surface 27 which is placed in this embodiment at the bottom of a housing 28 placed opposite a front surface 44 of the piston 29 which surrounds bolt 16; a loading spring 30 is placed, with initial compression, between a shoulder 31 of this piston and said bearing surface 27.

Piston 29 therefore receives a force directed in the opposite direction to F which would allow it to slide in this direction along the internal guide surface 32 of the body if it were not retained in the inactive position —I— shown in the figure by the two resilient latches 33,34 coming into abutment against projections 35,36 placed in the body between surface 32 and bore 25.

These projections may be advantageously represented by a concentric annular flange.

Figure 2A:
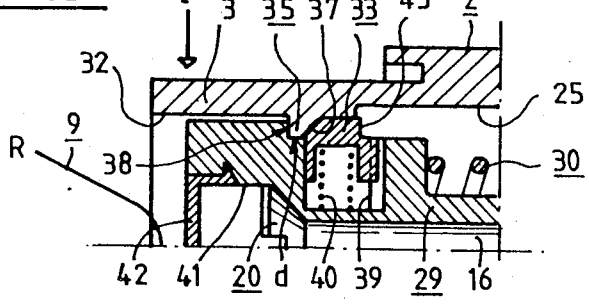
FIGS. 2*a* and 2*b* are two partial sectional views of two successive positions assumed by an abruptly moving piston during emergency operation of the switching apparatus.

These projections each have, in a direction opposite F, an inclined ramp 37 and a stopping surface 38, this latter being normal to the axis XX' as can be better seen in figure 2*a;* in this same figure, it will be noted that the latches are subjected radially to the resilient force of springs such as 40 and that they may slide in their housings such as 39.

The head 20 of bolt 16 may move longitudinally in axial housing 41 of the piston, which is closed at its end by an isolating cover 42 situated between said head and the actuating push-rod 9 of the switch.

The switch operates in two stages when, with the key separated from the cylinder, the push-button 10 is in the neutral position shown, when switch 8 is not actuated and when all the springs are in perfect condition.

In a first stage, the movement of push-button 10 in the direction opposite F causes additional compression of the loading spring 30 and brings, on the one hand, surface 27 in the vicinity of surface 44 and the head 20 in the vicinity of cover 42; the axial force imparted to piston 29 and retransmitted to latches 34,35 then causes, by cooperation with the ramp 37, a radial compression of springs 40 which results from the progressive driving in of the latches.

When the balanced position which these latches assume reaches a driving-in threshold —d—, see FIG. 2*a,* they may ride over the projections, which ends the first stage.

In a second stage, immediately following the first one, piston 29 is no longer retained and moves abruptly leftwards of the figure under the effect of the expansion of the loading spring 30 so as to bring the cover 42 against the switch push-rod 9 and cause actuation thereof.

At the end of travel, the piston then reaches its active position —A— which exceeds by a certain distance the working position —T—. In this position, piston 29 is retained axially by the head 20 of bolt 16 and the latches which have ridden over the projection are placed therebeyond. When the emergency push-button 10 is released, spring 17 brings it back rightwards, in the direction F, and head 20 applies to the piston 29 a force of the same direction which causes normal surfaces 45 of the latches to be applied against the bearing surfaces 38; the result is that the emergency push-button 10 is retained axially by the piston in a position driven in further than the neutral position —N— and that the trace of its actuation is then visible.

Figure 3:
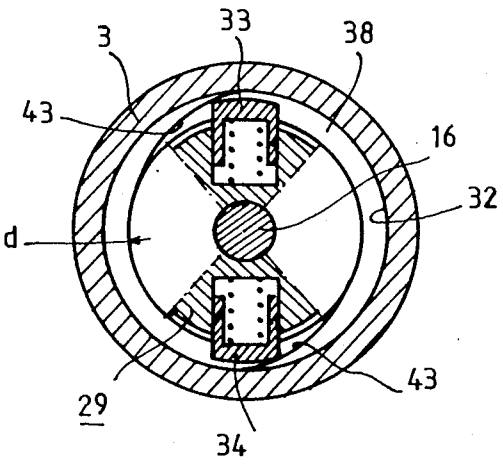
FIG. 3 is a left-hand side view, in partial section through the plane PP' of FIG. 2*b*.

It is clear that the operation which has just been described excludes any possibility of actuating the switch without the emergency push-rod being retained The switching apparatus is replaced in the neutral position by introducing the key 14 into the cylinder 13 and communicating thereto as well as to the slide 15 an angular movement established for example through mutual engagement at 46 of mating surfaces respectively belonging to the slide 15 and to the cylinder 13. During this movement, angular coupling means, such as a longitudinal pin 47 of the slider penetrating into a longitudinal channel 48 of the piston 29, allow this latter to be driven and the latches 34,35 to be driven in against fixed cam surfaces placed at 43 on surface 32 until said driving-in reaches the threshold —d— (see FIG. 3).

In this angular position, piston 29 may move rightwards in the direction —F— so as to cause the latches to ride over the projections in the reverse direction and so as to bring them into the position shown in FIG. 1.

Should a loading spring 30 break before the push-button 10 is actuated, or during such actuation, the emergency switching function would be established by the meeting of surfaces 27 and 44, and, consequently, by a progressive movement of piston 29 as far as its active position —A—.

If piston 29 is jammed in position —I—, for example because of jamming of the latches 33,34, the head 20 of bolt 16 would drive the cover 42 out of the housing 41 and would establish movement of push-rod 9 at least as far as its working position.

The central connecting bolt 16 which axially interlocks the emergency push-button 10, the lock cylinder 13 and slider 15 also serves in the example illustrated for retaining this emergency push-button in each of the neutral —N— or locked —V— positions, while allowing the slider 15 and piston 29 to rotate at the same time.

Figure 2B:
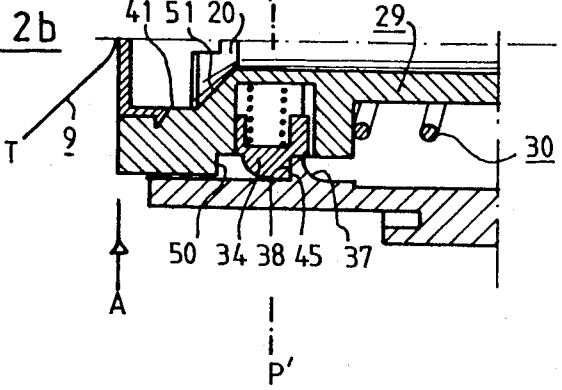

The emergency push-button is held longitudinally in position in these two positions,(against the action in direction —F— of the return spring 17), on the one hand by the surface 50 of piston 29 coming into abutment against the bearing surface 38, or by the latch surfaces 45 coming into abutment against this surface and, generally, by abutment of head 20 against the bottom 51 of housing 41, see FIGS. 2*a* and 2*b*.

The cover 42 also ensures the inviolable nature of the right-hand part of the apparatus before its association with the plate which supports it and establishes a double isolation made necessary by the presence of bolt 16.

What is claimed is:

1. A switching apparatus comprising an electric switch having an actuating member and an emergency push-button returned to a neutral position by a return spring and concentrically sliding on a tubular body fitted with an internal sliding piston which is retained by resilient latching means in an inactive position before the push button has linearly travelled over a given distance when the push button is pressed in and which is held in an active position by this same latching means when the push-button has linearly travelled over said given distance said sliding piston being abruptly propelled into engagement with the actuating member by means of a loading spring placed between the sliding piston and the push-button, said piston being mounted inside a bore at one end of the tubular body for moving from said inactive to said active positions, said piston being placed about a connecting coaxial bolt having a first end which is integral with the emergency push-button and a head which is located in close proximity to said actuating member so as to push said actuating member when the push-button has traveled over said given distance and yet the piston has not been able to move towards its active position.

2. A switching apparatus as claimed in claim 1, wherein a removable cover is disposed in the piston between said actuating member and said head.

3. A switching apparatus as claimed in claim 1, wherein the emergency push-button is retained in a locked position at a neutral position said neutral position located between the active position and the inactive position.

4. A switching apparatus as claimed in claim 1, wherein the emrgency push-button has an axial housing, a lock cylinder is rotatably mounted within said housing and a slider is slidably and rotatably mounted within said tubular body, said connecting bolt interlocking axially the emergency push-button, the lock cylinder and the slider, said slider transmitting, on the one hand, a longitudinal thrust to the loading spring when the push-buttom is pressed in and, on the other hand, a rotational torque to the piston when the lock cylinder is operated.

5. A switching apparatus as claimed in claim 4, wherein said slider has a longitudinal groove in which one end of said return spring is slidably secured.

* * * * *